US006691885B2

(12) United States Patent
Brown

(10) Patent No.: US 6,691,885 B2
(45) Date of Patent: Feb. 17, 2004

(54) COLLAPSIBLE STORAGE CONTAINER

(76) Inventor: Edmund W. Brown, 8715 Gittings Rd., Racine, WI (US) 53406

( * ) Notice: Subject to any disclaimer, the term of this patent is extended or adjusted under 35 U.S.C. 154(b) by 42 days.

(21) Appl. No.: 10/037,206

(22) Filed: Jan. 4, 2002

(65) Prior Publication Data

US 2003/0127456 A1 Jul. 10, 2003

(51) Int. Cl.[7] ..... B65D 6/22
(52) U.S. Cl. ..... 220/7; 220/6; 220/1.5
(58) Field of Search ..... 220/1.5, 6, 7, 1.6, 220/4.28, 4.33, 485, 668, 666

(56) References Cited

U.S. PATENT DOCUMENTS

| | | | | |
|---|---|---|---|---|
| 1,208,420 A | | 12/1916 | Watkins | |
| 2,862,640 A | | 12/1958 | Somavia | 220/4 |
| 2,964,210 A | | 12/1960 | Paley | 220/4 |
| 3,139,205 A | | 6/1964 | Haubrich | 217/47 |
| 3,360,180 A | | 12/1967 | Venturi | 229/30 |
| 3,497,127 A | | 2/1970 | Box | 229/30 |
| 3,648,877 A | | 3/1972 | Heft | 220/4 |
| 4,030,612 A | | 6/1977 | Gray | 211/192 |
| 4,150,762 A | | 4/1979 | Brunette | 220/19 |
| 4,163,495 A | | 8/1979 | Drader | 206/506 |
| 4,662,532 A | * | 5/1987 | Anderson et al. | 220/1.5 |
| 4,715,508 A | * | 12/1987 | Schurch | 220/1.5 |
| 4,863,056 A | | 9/1989 | Inayama | 220/6 |
| 5,161,709 A | | 11/1992 | Oestreich, Jr. | 220/6 |
| 5,253,763 A | | 10/1993 | Kirkley et al. | 206/600 |
| 5,415,311 A | * | 5/1995 | Coogan | 220/6 |

* cited by examiner

*Primary Examiner*—Stephen Castellano
(74) *Attorney, Agent, or Firm*—Boyle Fredrickson Newholm Stein & Gratz S.C.

(57) ABSTRACT

A collapsible storage container is provided. The storage container includes first and second collapsible walls and first and second removable walls. In its assembled configuration, the collapsible walls and the removable walls of the storage containers define an interior volume area for receiving fabricated products therein.

5 Claims, 14 Drawing Sheets

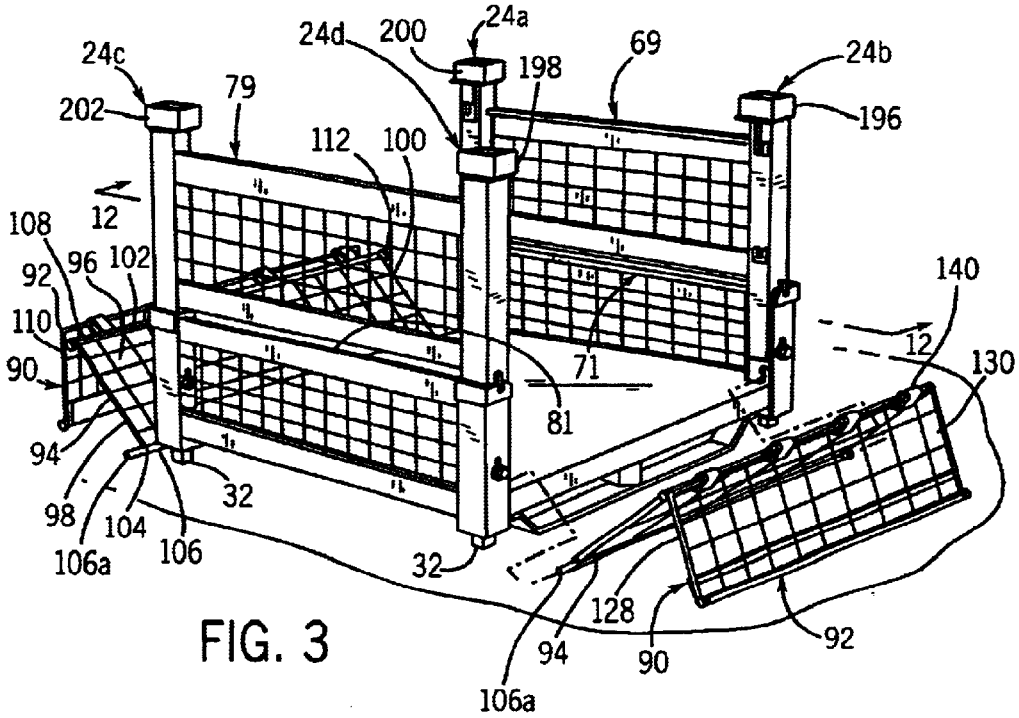
FIG. 3
FIG. 4
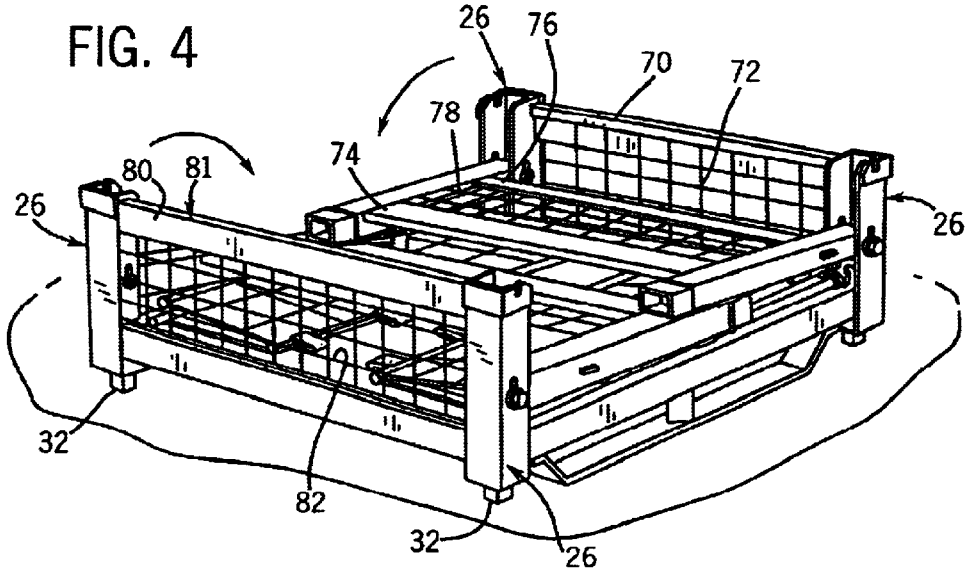

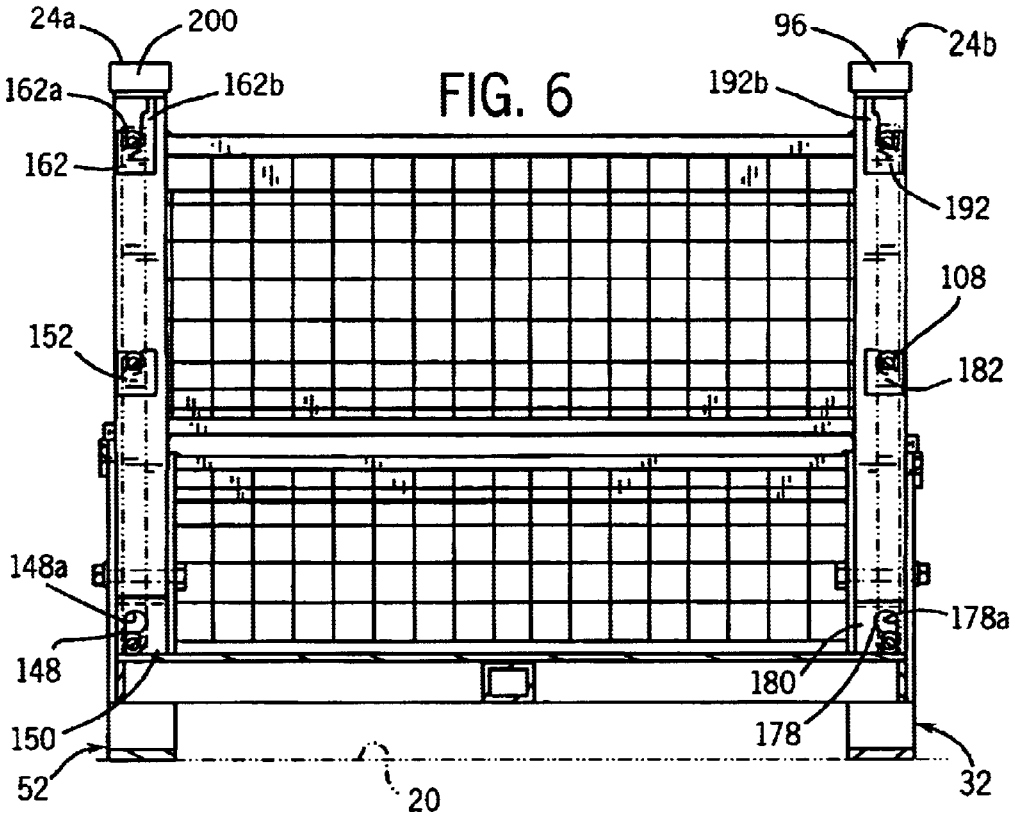
FIG. 6
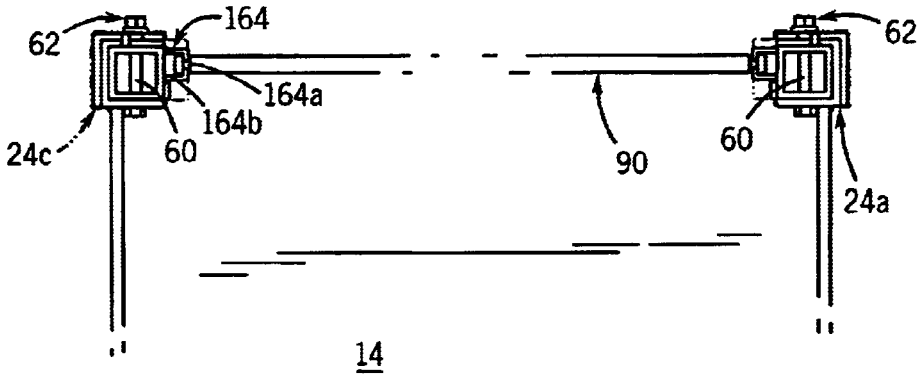
FIG. 7
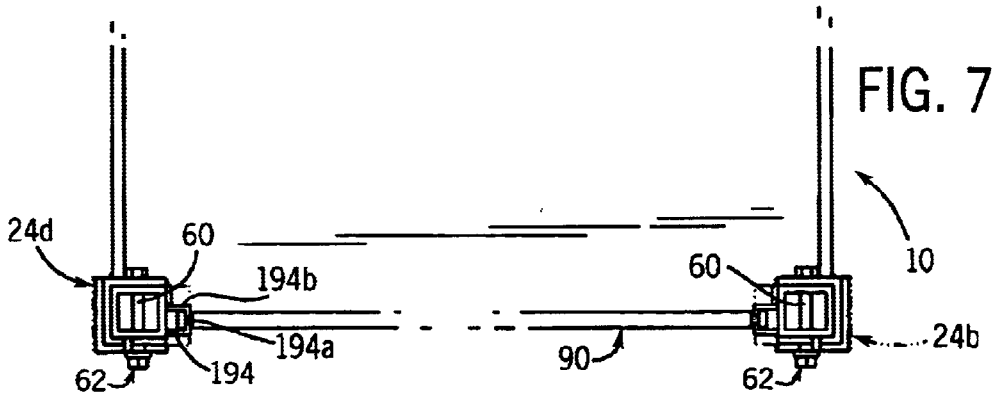

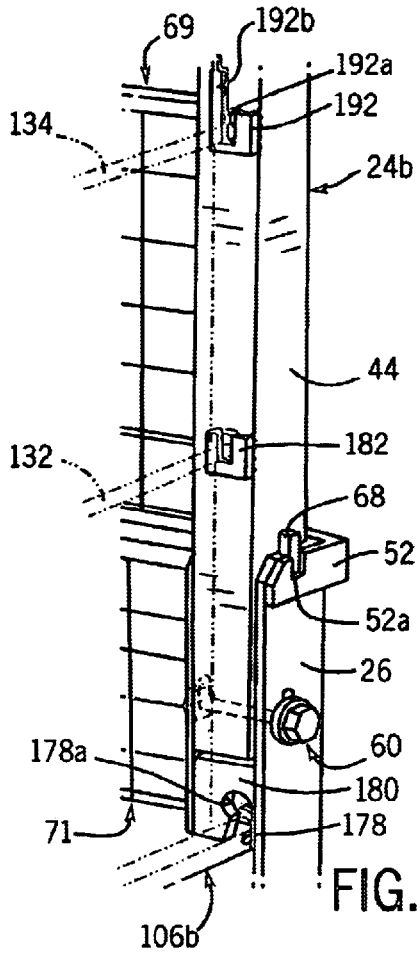
FIG. 16
FIG. 17
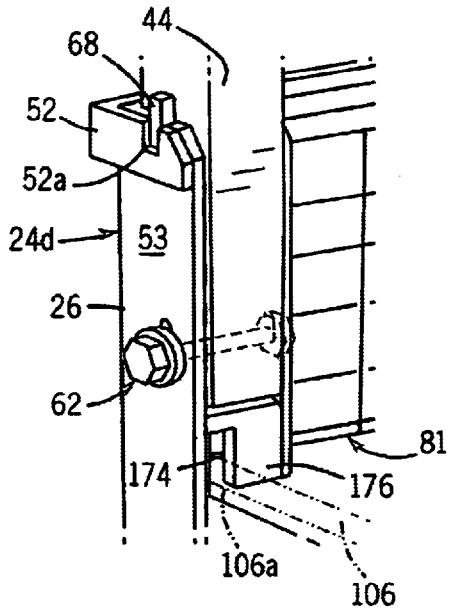
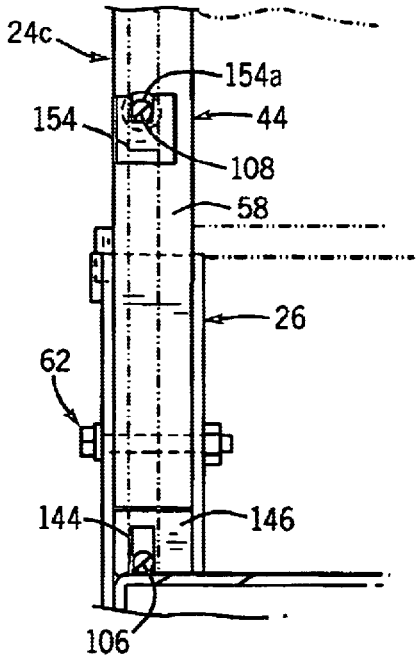
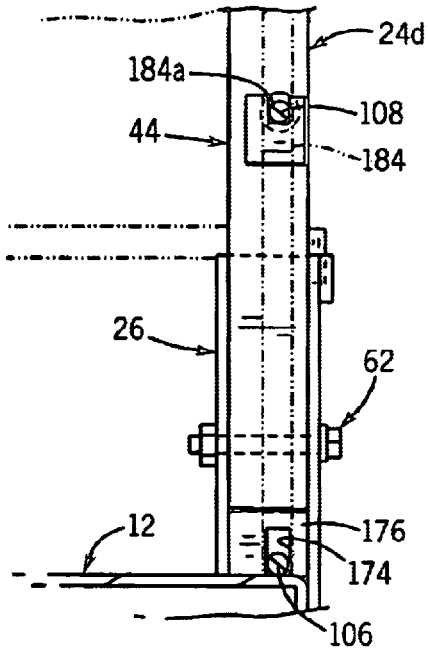
FIG. 15

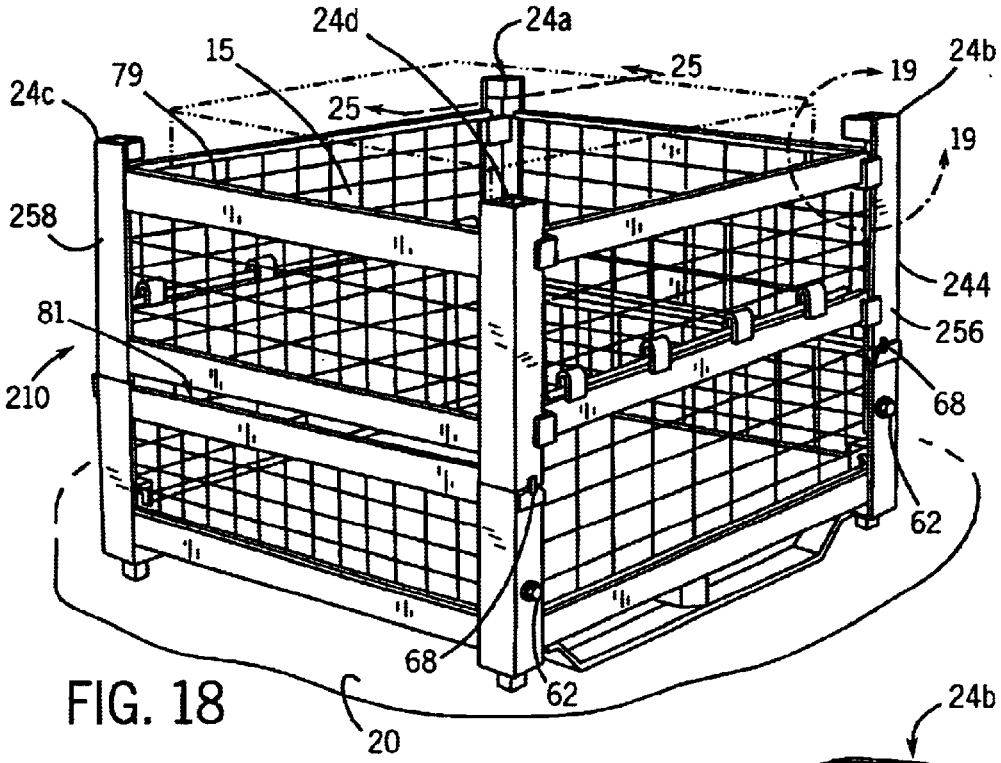
FIG. 18
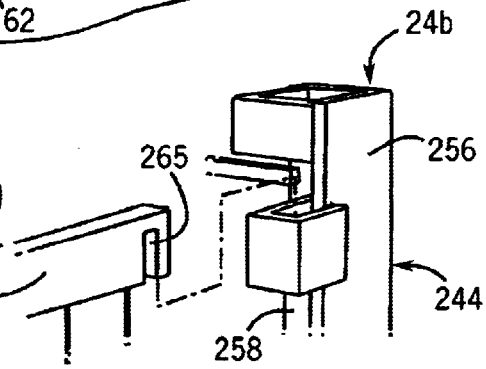
FIG. 19
FIG. 20
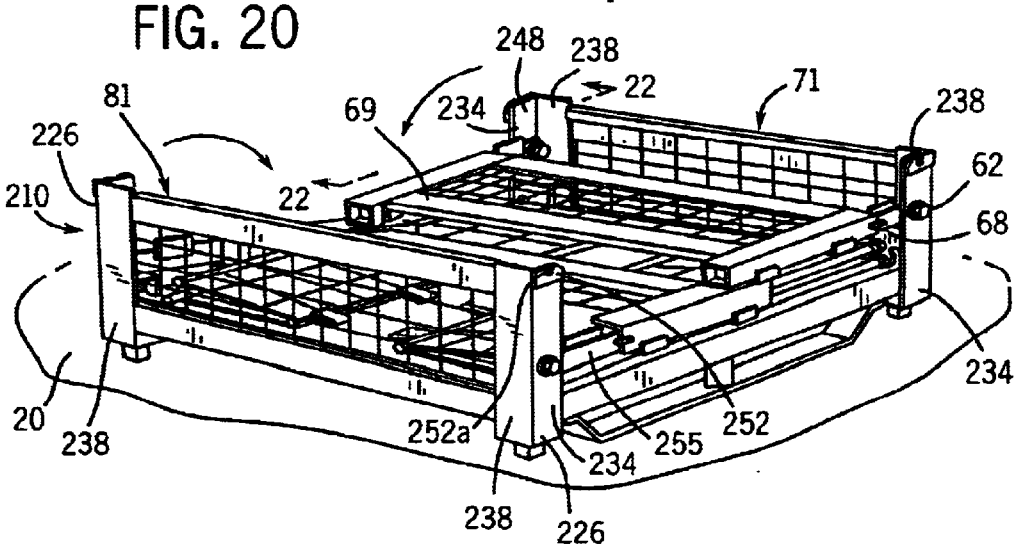

FIG. 25
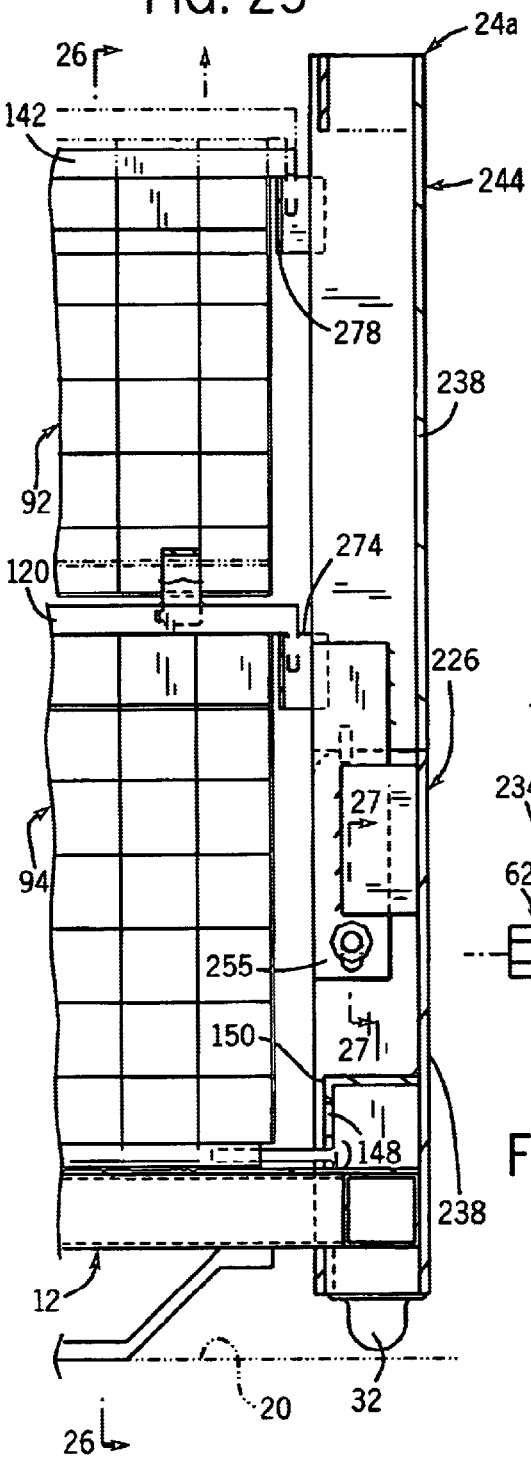
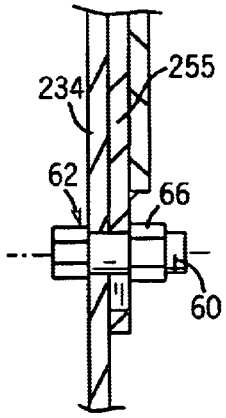
FIG. 27
FIG. 26
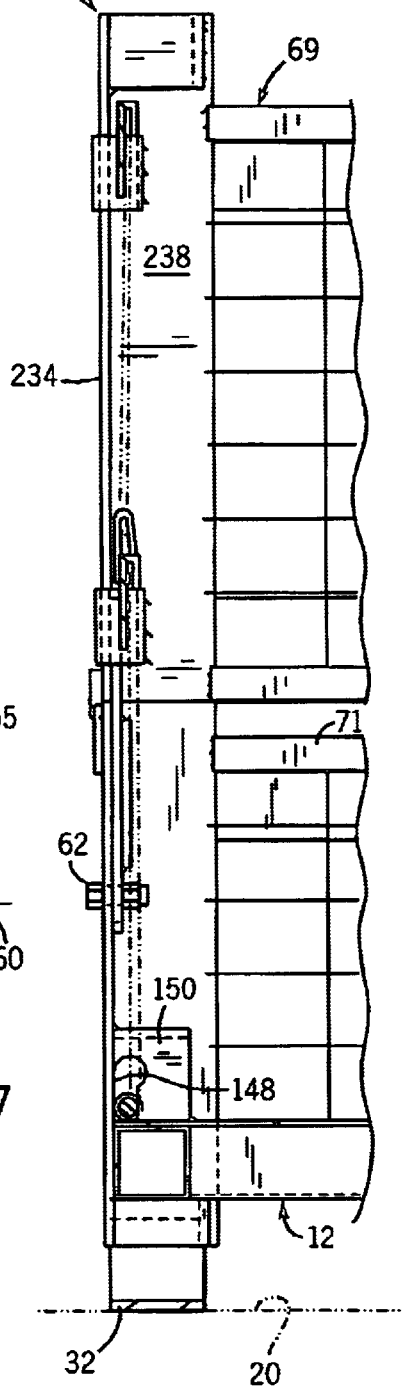

COLLAPSIBLE STORAGE CONTAINER

FIELD OF THE INVENTION

This invention relates generally to storage containers, and in particular, to a storage container which may be simply and easily collapsed when not in use.

BACKGROUND AND SUMMARY OF THE INVENTION

In factories, large storage containers are often used to store bulk products. By way of example, bulk products may be placed in the storage container after fabrication. Thereafter, these bulk products are transported to various work stations throughout the factory where such products are needed for further processing. Typically, these storage containers are transported by means of forklift trucks that carry the storage containers containing the bulk products between various locales in the factory. Consequently, it can be appreciated that such storage containers must be of sufficient strength and durability to withstand repeated handling by the forklifts.

In order for these storage containers to withstand repeated transport by forklift trucks, the storage containers must be constructed from a durable material such as steel or the like. In addition, these storage containers must have large capacities to hold a substantial quantity of bulk products. While functional for their intended purpose, these types of storage containers occupy a significant amount of floor space within a factory when not in use. Consequently, it is highly desirable to provide a storage container that may be collapsed when not in use, and yet, still retains sufficient strength and stability to withstand repeated transport thereof by a forklift truck.

Therefore, it is a primary object and feature of the present invention to provide a storage container of sufficient durability to withstand repeated transport by a forklift truck.

It is a still further object and feature of the present invention to provide a storage container that may be inverted between a storage configuration wherein the storage container may receive a plurality of bulk products therein and a storage configuration wherein the storage container is collapsed.

It is a still further object and feature of the present invention to provide a storage container which is inexpensive to manufacture and that may be simply and easily collapsed to a storage configuration.

In accordance with the present invention, a collapsible storage container is provided. The collapsible storage container includes a generally flat base having an upper surface. A first pair of support posts extends from the base. Each support post of the first pair of the support post includes a lower member, an upper member and a locking structure. The lower member has a first end interconnected to the base and a second opposite end. The upper member has a first end pivotably connected to the second end of the lower member. The upper member is pivotable between a first supporting position and a second collapsed position. The locking structure selectively retains the upper member in the supporting position. A lower sidewall extends between the lower members of the support posts of the first pair of support posts. An upper sidewall extends between the upper members of the support posts of the first pair of support posts.

The second end of each lower member includes a notch. The locking structure of each of the support posts of the first pair of the support posts includes a pin projecting laterally from the upper member. The pin is seated in a notch in the second end of a corresponding lower member with the upper member in the supporting position.

The container further includes a second pair of support posts extending from the base. Each support posts of the second pair of supports posts includes a lower member, an upper member and a locking structure. The lower member has a first end interconnected to the base and a second opposite end. The upper member has a first end pivotably connected to the second end of the lower member. The upper member is pivotable between a first supporting position and a second collapsed position. The locking structure selectively retains the upper member in the supporting position. A second lower sidewall extends between the lower members of the support posts of the second pair of support posts and a second upper sidewall extends between the upper members of the support posts of the second pair of support posts.

The lower members of the support posts of the first pair of support posts include openings directed towards corresponding lower members of the support posts of the second pair of support posts. Similarly, the lower members of the support posts of the second pair of support posts include openings directed toward corresponding lower members of the support posts of the first pair of support posts. The openings in the lower members of the supports of the first pair of support posts are axially aligned with corresponding openings in the lower members of the support posts of the second pair of support posts.

A first removable wall is also provided. The removable wall has a first connection pin projecting laterally from a first side of the first removable wall. The first connection pin is receivable in an opening in one of the locking members of the support posts of the first pair of the support posts. A second connection pin projects laterally from the second side of the first removable wall. The second connection pin is receivable in an opening in one of the lower members of the support posts of the second pair of support posts. The first removable wall includes a lower panel, an upper panel and a connection element. The lower panel has first and second sides and upper and lower edges. The panel has first and second sides and upper and lower edges. The connection element pivotably connects the upper edge of the lower panel to the lower edge of the upper panel such that the first removable wall is movable between a first vertical configuration wherein the upper and lower panels lie in a common plane and a folded configuration wherein the lower and upper panels are positioned adjacent each other.

The first connection pin projects laterally from the first side of the lower panel and the second connection pin projects laterally from the second side of the lower panel. The container further includes a first pin support element projecting from the upper member of one of the support posts of the first pair of support posts. The first pin support element is directed towards a corresponding upper member of one of the support posts of the second pair of support posts and includes a pin receipt recess therein. A second pin support element projects from the upper member of one of the support posts of the second pair of support posts. The second pin support element is directed towards a corresponding upper member of one of the support posts of the first pair of support posts and includes a pin receipt recess therein. The pin receipt recess of the first pin support element is axially aligned with the pin receipt recess of the second support post. A first mounting pin projects laterally from the first side of the upper panel. The first mounting pin is receivable in the pin receipt recess of the first pin support element. A second mounting pin projects laterally from the second side of the upper panel. The second mounting pin is receivable in the pin receipt recess of the second pin support element.

The upper panel is vertically movable with respect to the lower panel between a first seated position wherein the first mounting pin is received in the pin receipt recess of the first pin support element and the second mounting pin is received in the pin receipt recess of the second pin support element and a second removable position wherein the first mounting pin is vertically spaced from the pin receipt recess of the first pin support element and the second mounting pin is vertically spaced from the pin receipt recess of the second pin support element. The upper member of one of the vertical supports of the first pair of support posts terminates at the stop. The stop limits the vertical movement of the upper panel with respect to the lower panel.

The storage container may include a second removable wall having first and second sides. A first connection pin projects laterally from the first side of the second removable wall. The first connection pin is receivable in an opening in one of the lower members of the support posts of the first pair of support posts. A second connection pin projects laterally from the second side of the second removable wall. The second connection pin is receivable in an opening in one of the lower members of the support posts of the second pair of support posts.

In accordance with a further aspect of the present invention, a collapsible storage container is provided. The container includes a generally flat base having an upper surface. A first pair of support posts extends from the first side of the base. Each support posts of the first pair of support posts includes an opening therein. A second pair of support posts extends from the second side of the base. Each support posts of the second pair of support posts includes an opening therein. The openings in the support posts of the first pair of support posts are axially aligned with the corresponding openings in the support posts of the second pair of support posts. A first removable wall is also provided. A first connection pin projects laterally from a first side of the removable wall. The first connection pin is receivable in an opening in a first support post of the first pair of support posts. A second connection pin projects laterally from a second side of the first removable wall. The second connection pin is receivable in an opening in a first support post of the second pair of support posts.

The container also includes a second removable wall having first and second sides. A first connection pin projects laterally from the first side of the second removable wall. The first connection pin is receivable in an opening in a second support post of the first pair of support posts. A second connection pin projects laterally from the second side of the second removable wall. The second connection pin is receivable in an opening in a second support post of the second pair of support posts.

Each support post of the first pair of support posts includes a lower member having a first end interconnected to the base and a second opposite end. Each support post also includes an upper member having a first end pivotably connected to the lower member. The upper member is pivotable between a first supporting position and a second collapsed position.

Each lower member includes an oblong aperture therethrough. The upper members are pivotably connected to corresponding lower members by pivot pins extending through the apertures of the lower members. The pins are slidable in corresponding apertures to allow limited vertical movement of the upper members with respect to the lower members. The first end of the upper members are chamfered so as to facilitate the pivoting of the upper members.

In accordance with a further aspect of the present invention, a collapsible storage container is provided. The collapsible storage container includes a generally flat base having an upper surface. A first pair of support posts extends from a first side of the base. Each support post includes an opening therein. A second pair of support posts extends from the second side of the base. Each support post of the second pair of support posts includes an opening therein. The openings in the support posts of the first pair of support posts are axially aligned with corresponding openings in the support posts of the second pair of support posts. A first removable wall is provided. The removable wall includes a first connection pin projecting laterally from a first side of the removable wall and a second connection pin projecting laterally from the second side of the removable wall. The first connection pin is receivable in an opening in a first support posts of the first pair of support posts and the second connection is receivable in an opening in a first support posts of the second pair of support posts. The storage container includes a second removable wall having a first connection pin projecting laterally from a first side of the second removable wall and a second connection pin projecting laterally from the second side of the second removable wall. The first connection pin is receivable in the opening in a second support post of the first pair of support posts and a second connection pin is receivable in an opening in a second support post of the second pair of support posts. A first lower sidewall extends between the support posts of the first pair of support posts and an upper sidewall also extends between the support posts of the first pair of support posts. A lower sidewall extends between the support posts of the second pair of support posts and an upper sidewall also extends between the support posts of the second pair of support posts.

Each support post of the first pair of support posts includes lower and upper members. The lower member has a first end interconnected to the base and a second opposite end. The upper member has a first end pivotably connected to the lower member and a second end. The upper member is pivotable between a first supporting position and a second collapsed position. Each lower member also includes an oblong aperture therethrough. The upper members are pivotably connected to the lower members by pins extending through corresponding apertures in the lower members. The pins are slidable in the corresponding apertures to allow limited vertical movement of the upper members with respect to corresponding lower members. The first ends of the upper members are chamfered so as facilitate the pivoting of the upper members.

The first removable wall includes a lower panel, an upper panel and a connection element. The lower panel has first and second sides and upper and lower edges. Similarly, the upper panel has first and second sides and upper and lower edges. The connection element pivotably connects the upper edge of the lower panel and the lower edge of the upper panel such that the first removable wall is movable between the first vertical configuration wherein the lower and upper panels lie in a common plane and a folded configuration wherein the lower and upper panels are positioned adjacent each other. In addition, the upper panel is vertically removable with respect to the lower panel. The second end of at least one of the upper members of the support posts of the first pair of support posts includes a stop mounted therein for limiting the vertical movement of the upper panel with respect to the lower panel.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 3 is an isometric view of the storage container of FIG. 1 showing the first pair of sides removed therefrom;

FIG. 4 is an isometric view of the storage container of FIG. 1 showing a second pair of sides in a folded configuration;

FIG. 6 is a cross-sectional view of the storage container of the present invention taken along line 6—6 of FIG. 1;

FIG. 7 is a top plan view of the storage container of FIG. 1;

FIG. 15 is a cross-sectional view taken along line 15—15 of FIG. 1;

FIG. 16 is an isometric view showing a first portion of the storage container of FIG. 1;

FIG. 17 is an isometric view showing a second portion of the storage container of FIG. 1;

FIG. 18 is an isometric view of a second embodiment of a storage container in accordance with the present invention;

FIG. 19 is a cross-sectional view of the storage container of the present invention taken along line 19—19 of FIG. 18;

FIG. 20 is an isometric view of the storage container of FIG. 18 and a collapsed configuration;

FIG. 25 is a cross-sectional view of the storage container of the present invention taken along line 25—25 of FIG. 18;

FIG. 26 is a cross-sectional view of the storage container of the present invention taken along line 26—26 of FIG. 25;

FIG. 27 is a cross-sectional view of the storage container of the present invention taken along line 27—27 of FIG. 25;

DETAILED DESCRIPTION OF THE DRAWINGS

Figure 1:
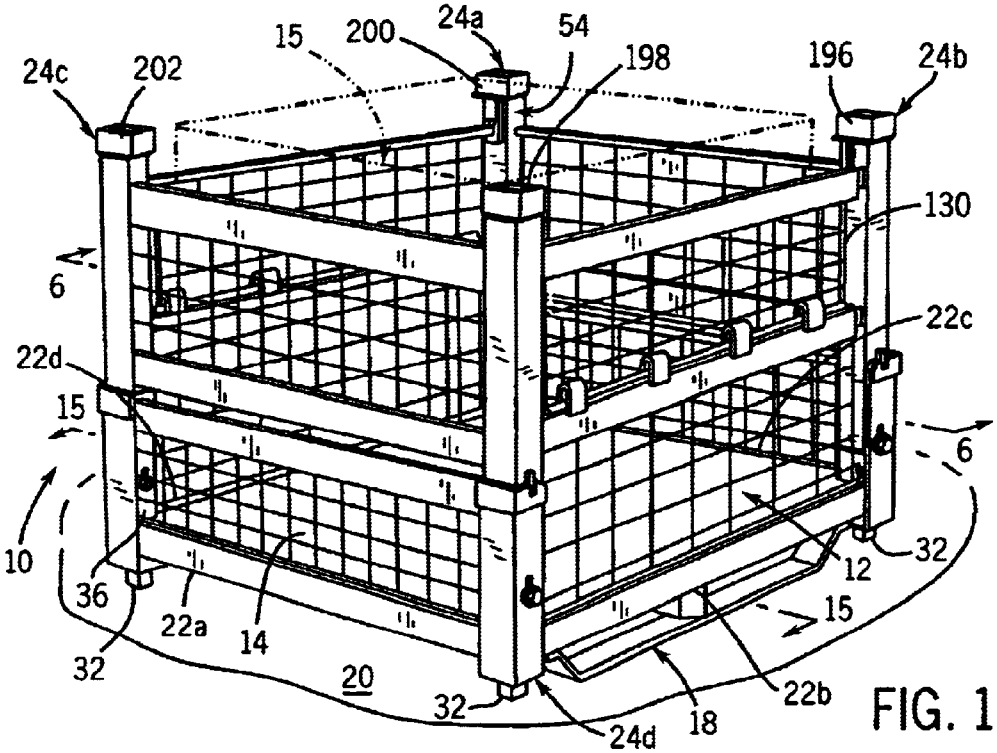
FIG. 1 is an isometric view of a storage container in accordance with the present invention.

Referring to FIG. 1, a storage container in accordance with the present invention is generally designated by the reference numeral 10. Storage container 10 defines an interior storage volume 15 and includes a generally flat base 12 having upper surface 14 and lower surface 16. Support legs 18 project from lower surface 16 of base 12 in order to support storage container 10 above a supporting surface 20 such as a floor or the like.

Base 12 of storage container 10 is generally square in shape and includes outer edges 22*a*–22*d*. Support posts 24*a*–24*d* project vertically from the corresponding corners of base 12. Each support post 24*a*–24*d* includes upper and lower members 44 and 26, respectively, that are pivotably interconnected, as hereinafter described. Each lower member 26 has a lower end 28 and an upper end 30. Lower ends 28 of lower members of support posts 24*a*–24*d* include feet 32 depending therefrom for supporting storage container 10 above supporting surface 20.

Referring to FIGS. 9–12, lower members 26 of posts 24*a*–24*d* have a generally U-shaped cross-section and include sidewalls 34 and 36 and rear walls 38 that define cavities 40 for pivotably receiving corresponding lower ends 42 of upper members 44, as hereinafter described. Sidewalls 34 and 36 of each lower member 26 include corresponding oblong apertures 34*a* and 36*a*, respectively, therethrough which are axially aligned with each other. Notch 48 is provided in upper end 50 of sidewall 36 of each lower member 26. Reinforcing plates 52 are affixed to outer surfaces 53 of sidewalls 36 adjacent upper ends 50 thereof. Each reinforcing plate 52 also includes a notch 52*a* therein which is axially aligned with notch 48 in a corresponding sidewall 36, for reasons hereinafter described.

Figure 9:
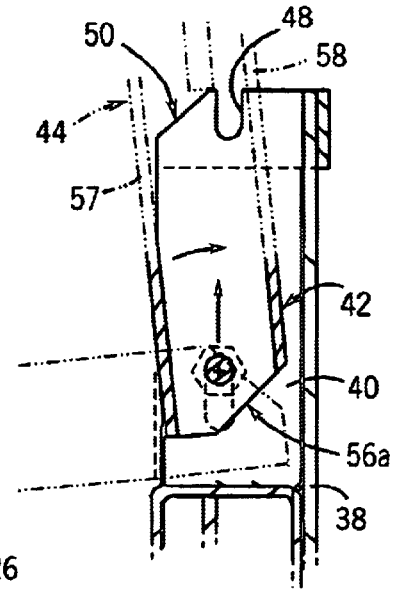
FIG. 9 is a cross-sectional view of the storage container of the present invention taken along line 9—9 of FIG. 8.
Figure 11:
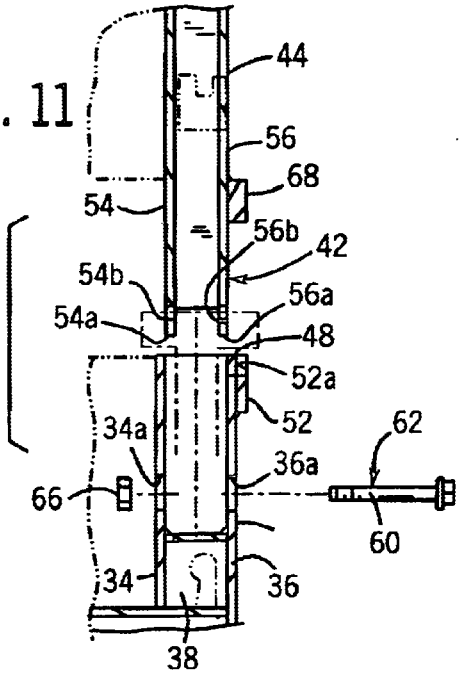
FIG. 11 is an exploded, cross-sectional view of the storage container of the present invention taken along line 11—11 of FIG. 10.

Each upper member 44 of support posts 24*a*–24*d* is generally tubular and is defined by first and second sidewalls 54 and 56, respectively, and by front and rear walls 57 and 58, respectively. As best seen in FIG. 9, lower ends 54*a* and 56*a* of sidewalls 54 and 56, respectively, of lower members 44 are chamfered so as to facilitate the pivoting of upper members 44 with respect to lower members 26, as hereinafter described. Sidewalls 54 and 56 of lower members 44 further include axially aligned apertures 56*b* and 56*b*, respectively, therein. It can be appreciated that lower ends 42 of upper members 44 are receivable in corresponding cavities 40 in lower members 26 such that apertures 54*b* and 56*b* in sidewalls 54 and 56, respectively, are aligned with oblong apertures 34*a* and 36*a* in sidewalls 34 and 36, respectively, of corresponding lower members 26.

Figure 10:
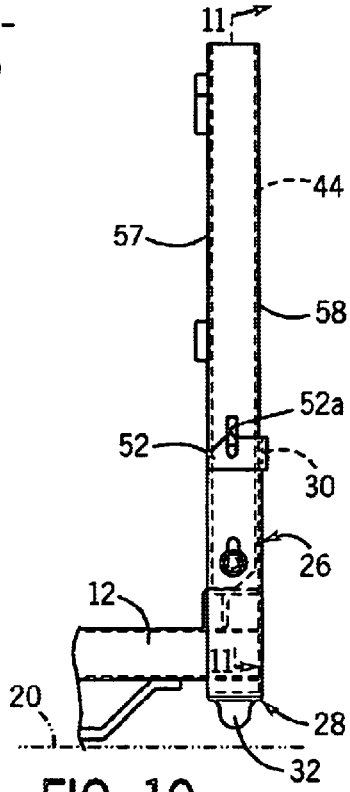
FIG. 10 is a cross-sectional view showing a portion of the storage container of FIG. 1.

In order to pivotably connect upper members 44 and corresponding lower members 26, shafts 60 of carriage bolts 62 extend through apertures 34*a* and 34*b* in sidewalls 34 and 36, respectively, of lower members 26 and through corresponding apertures 54*b* and 56*b* in sidewalls 54 and 56, respectively, of corresponding upper members 44. Nuts 66 are threaded onto corresponding shafts 60 of carriage bolts 62 to retain carriage bolts 62 in position. As best seen in FIGS. 9–10, the diameter of shafts 60 of carriage bolts 62 are less than the vertical length of oblong apertures 34*a* and 36*a* in sidewalls 34 and 36, respectively, of corresponding lower members 26 so as to allow limited vertical movement of upper members 44 with respect to corresponding lower members 26 between a vertical pivoting position, FIG. 9, and a locked position, FIG. 10. Locking pins 68 project laterally from sidewalls 56 of upper members 44 and are receivable within corresponding notches 48 and 52*a* when upper members 44 are in the locking position so as to prevent upper members 44 from pivoting with respect to lower members 26.

Referring to FIGS. 1–4, support posts 24*a* and 24*b* are interconnected by upper and lower panels 69 and 71, respectively. Lower panel 69 includes upper support bar 70 extending between sidewalls 34 of lower members 26 of support posts 24*a* and 24*b*. Wire mesh screen 72 also extends between sidewalls 34 of lower members 26 of support posts 24*a* and 24*b*, as well as, between upper support bar 70 and base 12. Upper panel 71 includes upper and lower support bars 74 and 76, respectively, extending between sidewalls 54 of upper members 44 of support posts 24*a* and 24*b*. Upper and lower support bars 74 and 76, respectively, of upper panel 71 are spaced from and parallel to each other. Wire mesh screen 78 also extends between sidewalls 54 of upper members 44 of support posts 24*a* and 24*b*, as well as, between upper and lower support bars 74 and 76, respectively.

Support posts 24*c* and 24*d* are interconnected by upper and lower panels 79 and 81, respectively. Lower panel 79 includes upper support bar 80 extending between sidewalls 34 of lower members 26 of support posts 24*c* and 24*d*. Wire mesh screen 82 also extends between sidewalls 34 of lower members 26 of support posts 24*c* and 24*d*, as well as, between upper support bar 80 and base 12. Upper panel 81 includes upper and lower support bars 84 and 86, respectively, extending between sidewalls 54 of upper members 44 of support posts 24*c* and 24*d*. Upper and lower support bars 84 and 86, respectively, of upper panel 81 are spaced from and parallel to each other. Wire mesh screen 88 also extends between sidewalls 54 of upper members 44 of support posts 24*c* and 24*d*, as well as, between upper and lower support bars 84 and 86, respectively.

Figure 5:
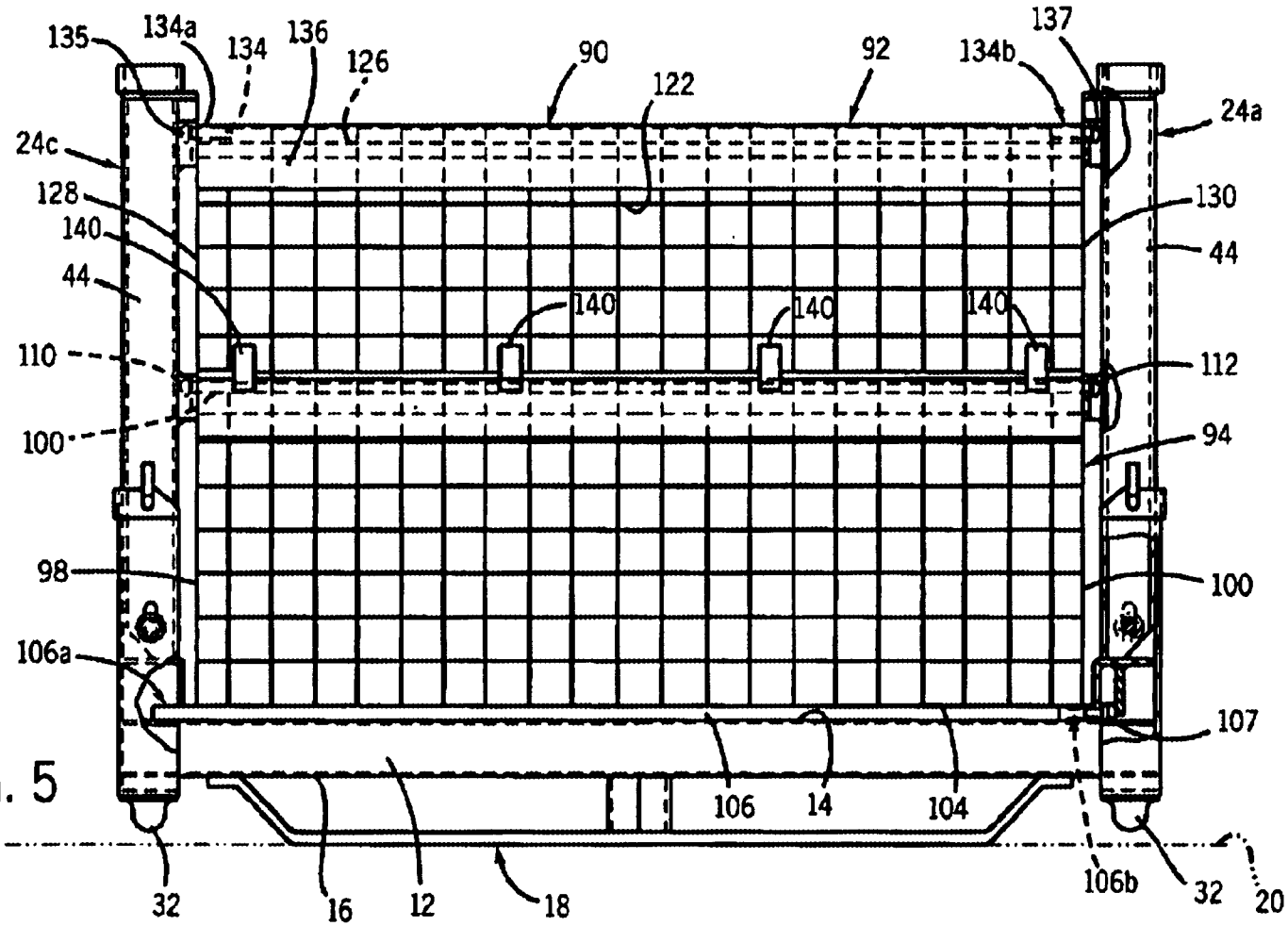
FIG. 5 is a side elevational view of the storage container of FIG. 1.
Figure 8:
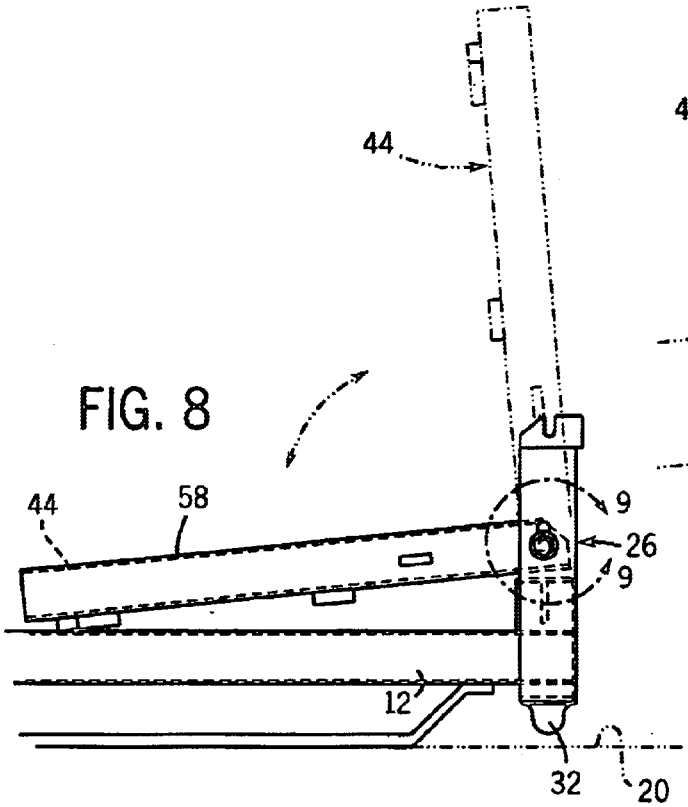
FIG. 8 is a side elevational view showing a portion of the storage container of FIG. 1.
Figure 12:
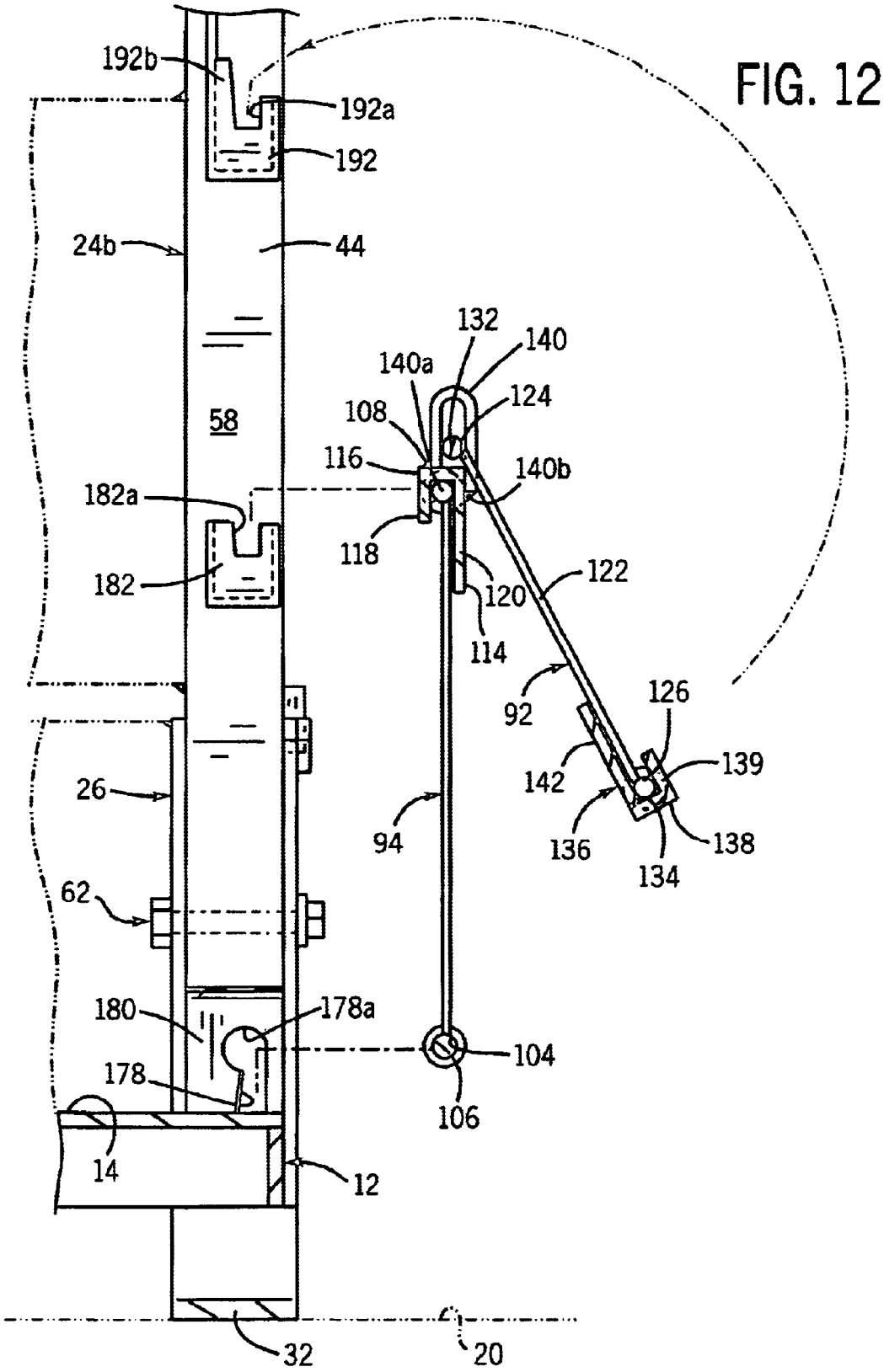
FIG. 12 is a cross-sectional view of the storage container of the present invention taken along line 12—12 of FIG. 3.

Storage container 10 further includes a pair of removable gates 90. As best seen in FIGS. 3 and 5, each gate 90 includes upper and lower panels 92 and 94, respectively. Each lower panel 94 includes a generally rectangular wire mesh screen 96 having opposite ends 98 and 100, and opposite sides 102 and 104. Lower support rod 106 extends along side 104 of wire mesh screen 96 and has a first end 106*a* extending beyond end 98 thereof and a second end 106*b* extending beyond end 100 thereof. Second end 106*b* of lower support rod 106 includes terminates at an enlarged head 107, for reasons hereinafter described. Similarly, upper support rod 108 extends along side 102 of wire mesh screen 96 beyond ends 98 and 100 thereof. Upper support rod terminates at enlarged heads 110 and 112, for reasons hereinafter described. Referring to FIG. 12, a generally J-shaped support bracket 114 is positioned over and is interconnected to upper support rod 108. Support bracket 114 includes a base 116 having support legs 118 and 120 depending therefrom for receiving support rod 108 therebetween.

Upper panels 92 of gates 90 include wire mesh screens 122 having opposite sides 124 and 126 and opposite ends 128 and 130. Lower support rods 132 extend along the entire length of sides 124 of wire mesh screens 122. Similarly, upper support rods 134 extend along the entire length of sides 126 of wire mesh screens 122 and beyond ends 128 and 130 of wire mesh screens 122, for reasons hereinafter described. First ends 134*a* of upper support rods 134 terminate at enlarged heads 135 and second ends 134*b* of upper support rods 134 terminate at enlarged heads 137. Generally J-shaped support brackets 136 are positioned over and are interconnected to corresponding upper support rods 134. Each upper support rod 134 includes base 138 having legs 139 and 142 depending therefrom for receiving a corresponding upper support rod 134 therebetween, FIG. 12.

Upper and lower panels 92 and 94, respectively, of gates 90 are interconnected by a plurality of generally U-shaped connectors 140 spaced along corresponding support brackets 114 of lower panels 94. Each connector 140 has a first end 140*a* interconnected to base 116 of a corresponding support bracket 114 and a second end 140*b* interconnected to leg 120 of a corresponding support bracket 114 so as to define an oblong passageway 141 to capture lower support rod 132 of upper panel 92. Passageways 141 through connectors 140 are of sufficient dimension so as to allow limited vertical movement of lower support rod 132 of upper panel, and hence of upper panel 92, with respect to lower panel 94.

In order to assemble storage container 10, upper members 44 are pivoted with respect to corresponding lower members 26 from the collapsed position, FIG. 4, to the vertical pivoting position, FIG. 4. Thereafter, upper panels 94 are released such that upper panels 94 move vertically downward to the locked positions, FIG. 10, wherein pins 68 become seated in corresponding notches 48 and 52*a* in order to lock support posts 24*a*–24*d* in position.

One of the pair of gates 90 is positioned between support posts 24*a* and 24*c*. As best seen in FIG. 15, first end 106*a* of lower support rod 106 is inserted into generally rectangular opening 144 in plate 146 that extends between sidewalls 34 and 36 of lower member 26 of support post 24*c*. Head 107 at second end 106*b* of lower support rod 106 is inserted through enlarged portion 148*a* of opening 148 in plate 150 that extends between sidewalls 34 and 36 of lower member 26 of support post 24*a*, FIG. 6. Openings 144 and 148 through plates 146 and 150, respectively, are of sufficient vertical length to allow for limited vertical movement of lower support rod 106, and hence, of lower panel 94 of gate 90.

Lower panel 94 of gate 90 between support posts 24*a* and 24*c* is pivoted to a vertical position such that heads 110 and 112 of upper support rod 108 are aligned with corresponding pockets 152 and 154 projecting from front walls 58 of upper members 44 of support posts 24*a* and 24*c*, respectively. Lower panel 94 of gate 90 is then released so as to allow lower panel 94 to move vertically downward such that heads 110 and 112 become seated in corresponding pockets 152 and 154, respectively, FIG. 2. It can be appreciated that notches 152*a* and 154*a* may be provided in pockets 152 and 154, respectively, to allow upper support rod 108 of lower panel 94 of gate 90 to pass therethrough.

Figure 2:
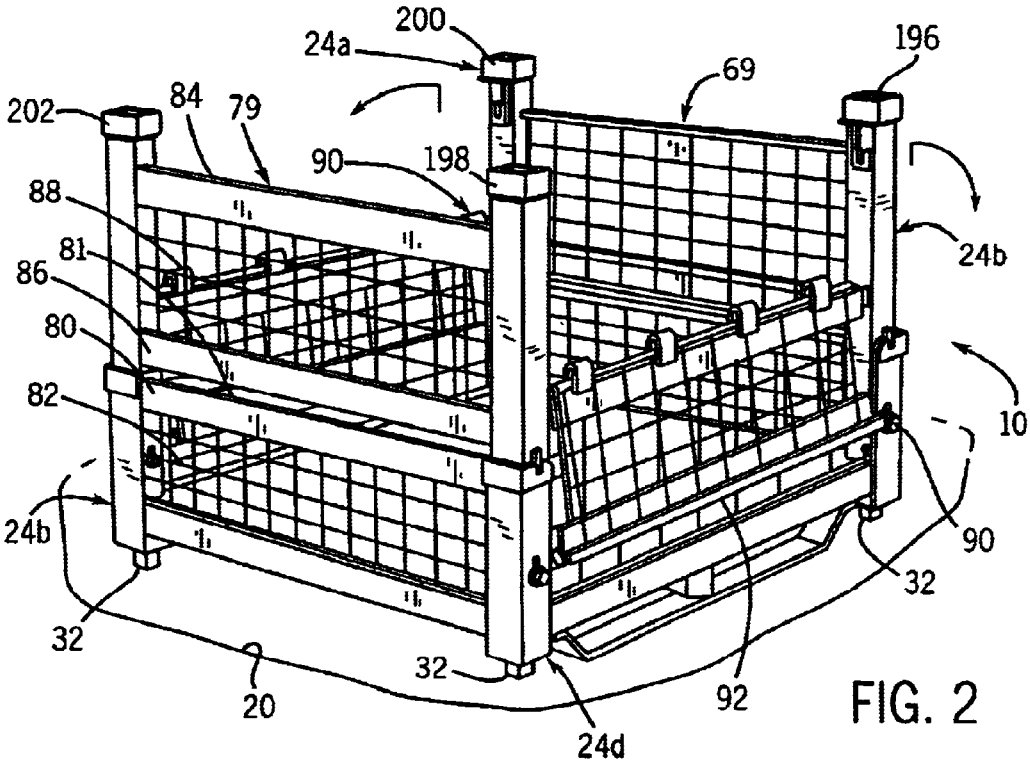
FIG. 2 is an isometric view of the storage container of FIG. 1 having a first pair of side walls in a folded configuration.

With lower panel 94 of gate 90 fixed between support posts 24*a* and 24*b*, upper panel 92 of gate 90 is pivotable between a folded configuration, FIG. 2, wherein upper panel 92 is adjacent lower panel 92 and a vertical configuration, FIG. 1, wherein upper panel 92 and lower panel 94 of gate 90 lie in a common plane. As upper panel 92 is pivoted to the vertical configuration, heads 135 and 137 of upper support rod 134 are aligned with corresponding pockets 162 and 164 projecting from front walls 58 of upper members 44 of support posts 24*a* and 24*c,* respectively. Upper panel 92 of gate 90 is then released so as to allow upper panel 92 to move vertically downward such that heads 135 and 137 become seated in corresponding pockets 162 and 164, respectively, FIGS. 1, 6 and 7. It can be appreciated that notches 162*a* and 164*a* may be provided in pockets 162 and 164, respectively, to allow upper support rod 134 of upper panel 92 of gate 90 to pass therethrough. In addition, pockets 162 and 164 may be provided with stop portions 162*b* and 164*b,* respectively, to prevent upper panel 92 of gate 90 from pivoting past the vertical configuration into the interior of storage container 10.

The other of the pair of gates 90 is positioned between support posts 24*b* and 24*d*. As best seen in FIGS. 15 and 17, first end 106*a* of lower support rod 106 is inserted into generally rectangular opening 174 in plate 176 that extends between sidewalls 34 and 36 of lower member 26 of support post 24*d.* Head 107 at second end 106*b* of lower support rod 106 is inserted through enlarged portion 178*a* of opening 178 in plate 180 that extends between sidewalls 34 and 36 of lower member 26 of support post 24*b,* FIGS. 6 and 12–16. Openings 174 and 178 through plates 176 and 180, respectively, are of sufficient vertical length to allow for limited vertical movement of lower support rod 106, and hence, of lower panel 94 of gate 90.

Lower panel 94 of gate 90 between support posts 24*b* and 24*d* is pivoted to a vertical position such that heads 110 and 112 of upper support rod 108 are aligned with corresponding pockets 182 and 184 projecting from front walls 58 of upper members 44 of support posts 24*b* and 24*d,* respectively. Lower panel 94 of gate 90 is then released so as to allow lower panel 94 to move vertically downward such that heads 110 and 112 become seated in corresponding pockets 182 and 184, respectively, FIG. 2. It can be appreciated that notches 182*a* and 184*a* may be provided in pockets 182 and 184, respectively, to allow upper support rod 108 of lower panel 94 of gate 90 to pass therethrough.

Figure 13:
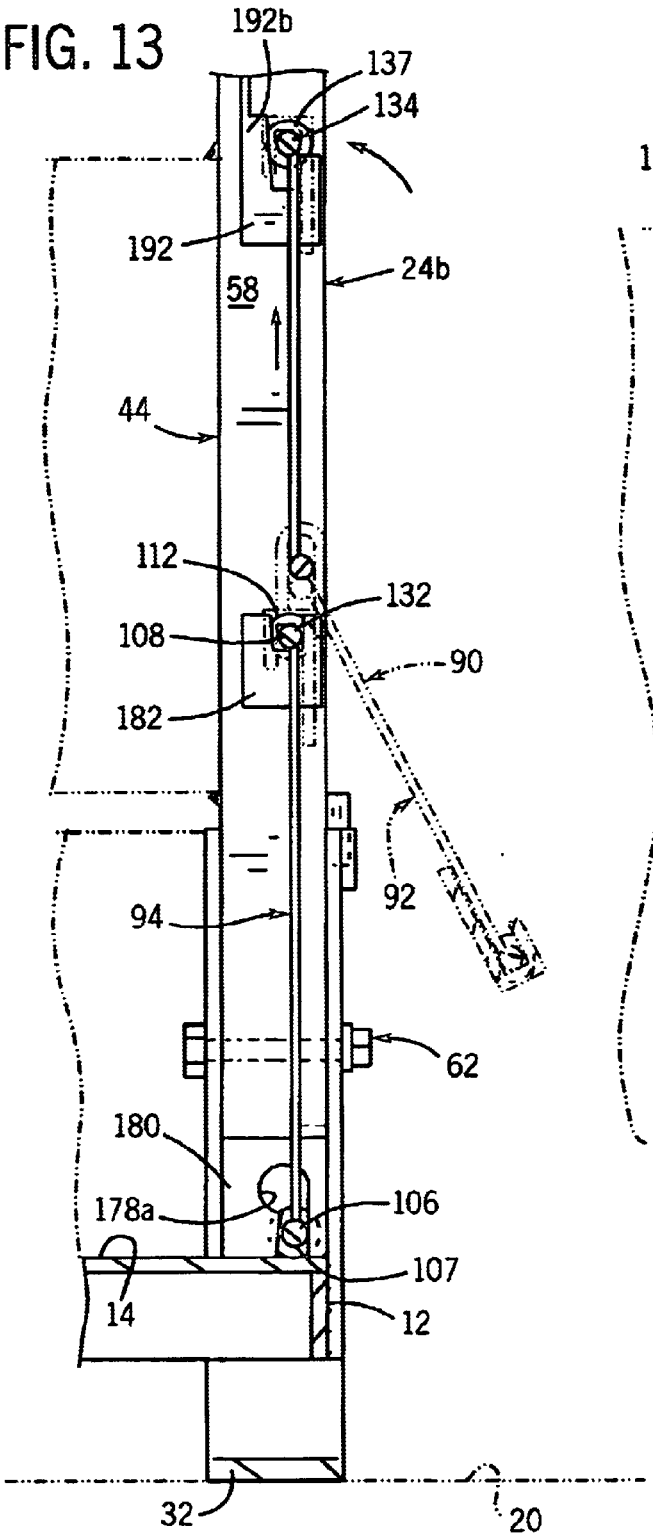
FIG. 13 is a cross-sectional view, similar to FIG. 12, showing a portion of the storage container of FIG. 1.
Figure 14:
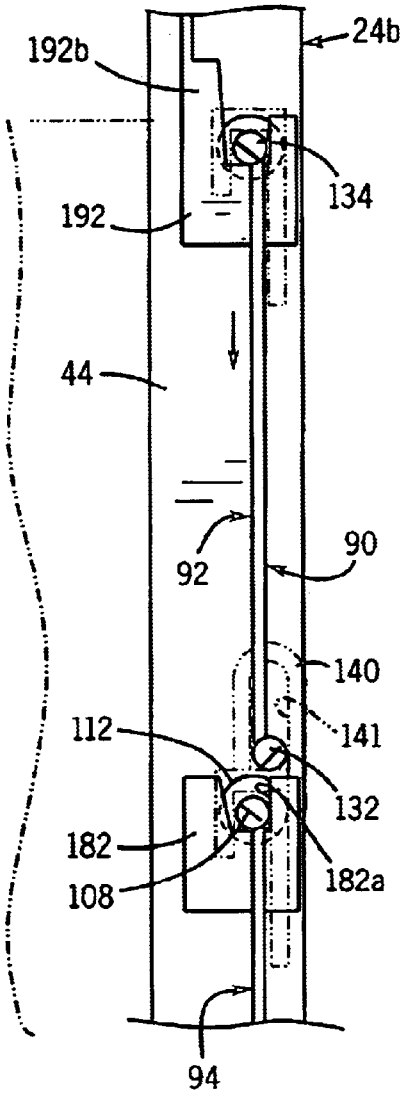
FIG. 14 is an enlarged, cross-sectional view of the storage container of FIG. 13.
Figure 21:
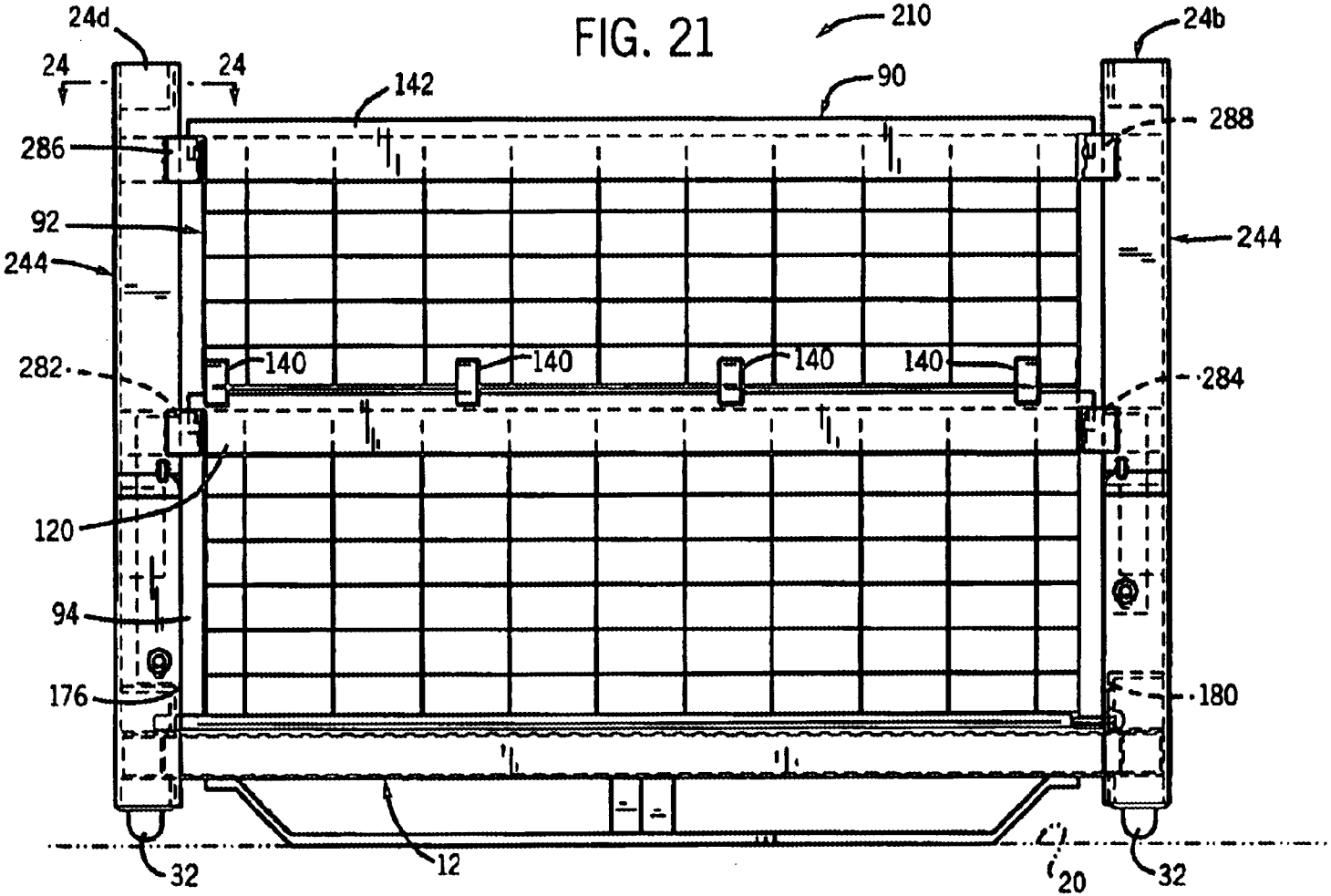
FIG. 21 is a side elevational view of the storage container of FIG. 18.

Referring to FIGS. 2, 12 and 13, with lower panel 94 of gate 90 fixed between support posts 24*b* and 24*d,* upper panel 92 of gate 90 is pivotable between a folded configuration, FIG. 2, wherein upper panel 92 is adjacent lower panel 92 and a vertical configuration, FIGS. 1 and 13, wherein upper panel 92 and lower panel 94 of gate 90 lie in a common plane. As upper panel 92 is pivoted to the vertical configuration, heads 135 and 137 of upper support rod 134 are aligned with corresponding pockets 192 and 194 projecting from front walls 58 of upper members 44 of support posts 24*b* and 24*d,* respectively. Upper panel 92 of gate 90 is then released so as to allow upper panel 92 to move vertically downward such that heads 135 and 137 become seated in corresponding pockets 192 and 194, respectively, FIGS. 1 and 6. It can be appreciated that notches 192*a* and 194*a* may be provided in pockets 192 and 194, respectively, to allow upper support rod 134 of upper panel 92 of gate 90 to pass therethrough. In addition, pockets 192 and 194 may be provided with stop portions 192*b* and 194*b,* respectively, to prevent upper panel 92 of gate 90 from pivoting past the vertical configuration into the interior of storage container 10.

In order to collapse storage container 10, the process is reversed. Upper panel 92 of the gate 90 between support posts 24*b* and 24*d* is lifted vertically such that heads 135 and 137 are removed from corresponding pockets 192 and 194, respectively, thereby allowing upper panel 92 to pivot. The vertical movement of upper panel 92 is limited by end caps 196 and 198 provided on the upper ends of support posts 24*b* and 24*d*, respectively. Thereafter, upper panel 92 is returned to the folded configuration, FIG. 2. Lower panel 94 of the gate 90 between support posts 24*b* and 24*d* is removed by lifting lower panel 94 vertically such that heads 110 and 112 are removed from pockets 182 and 184, respectively, and pivoting lower panel 94 from its vertical position. Head 107 at second end 106*b* of lower support rod 106 is removed from opening 178 in plate 180 through enlarged portion 178*a* of opening 178. In addition, first end 106*a* of lower support rod 106 is removed from into generally rectangular opening 174 in plate 176 thereby disengaging gate 90 from storage container 10.

Gate 90 between support posts 24*a* and 24*c* is removed by lifting upper panel 92 vertically such that heads 135 and 137 are removed from corresponding pockets 162 and 164, respectively, thereby allowing upper panel 92 to pivot. The vertical movement of upper panel 92 is limited by end caps 200 and 202 provided on the upper ends of support posts 24*a* and 24*c,* respectively. Thereafter, upper panel 92 is returned to the folded configuration, FIG. 2. Lower panel 94 of the gate 90 between support posts 24*a* and 24*c* is removed by lifting lower panel 94 vertically such that heads 110 and 112 are removed from pockets 152 and 154, respectively, and pivoting lower panel 94 from its vertical position. Head 107 at second end 106*b* of lower support rod 106 is removed from opening in plate 150 through enlarged portion 148*a* of opening 148. In addition, first end 106*a* of lower support rod 106 is removed from into generally rectangular opening 144 in plate 146 thereby disengaging the second of the pair of gates 90 from storage container 10, FIG. 3.

In order to fully collapse storage container 10, upper members 44 of support posts 24*a*–24*d* are lifted vertically with respect to corresponding lower members 26 to the vertical pivoting position, FIG. 3, wherein pins 68 are disengaged from corresponding notches 48 and 52*a*. Thereafter, upper members 44 are pivoted on corresponding shafts 60 of carriage bolts 62 towards base 12 to the collapsed position, FIG. 4.

Referring to FIGS. 18–29, an alternate storage container in accordance with the present invention is generally designated by the reference numeral 210. Except as hereinafter provided, storage container 210 is identical in structure to storage container 10 heretofore described. As such, the previous description of storage container 10 is understood to describe the common components of storage container 210 as if fully described hereinafter.

Figure 24:
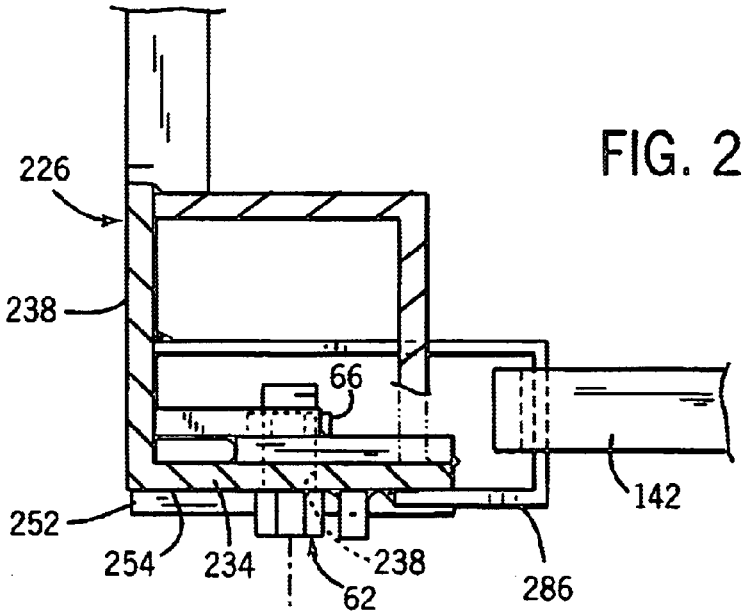
FIG. 24 is a cross-sectional view of the storage container of the present invention taken along line 24—24 of FIG. 21.

Referring to FIGS. 20 and 24, lower members 226 of posts 24*a*–24*d* have a generally L-shaped cross-section and include sidewalls 234 and rear walls 238. Sidewalls 234 of each lower member 226 include corresponding apertures 234*a* therethrough. Notch 248 is provided in upper end 250 of sidewall 234 of each lower member 226. Reinforcing plates 252 are affixed to outer surfaces 254 of sidewalls 234 adjacent upper ends 250 thereof. Each reinforcing plate 252 also includes a notch 252*a* therein which is axially aligned with notch 248 in a corresponding sidewall 234, for reasons hereinafter described.

Figure 22:
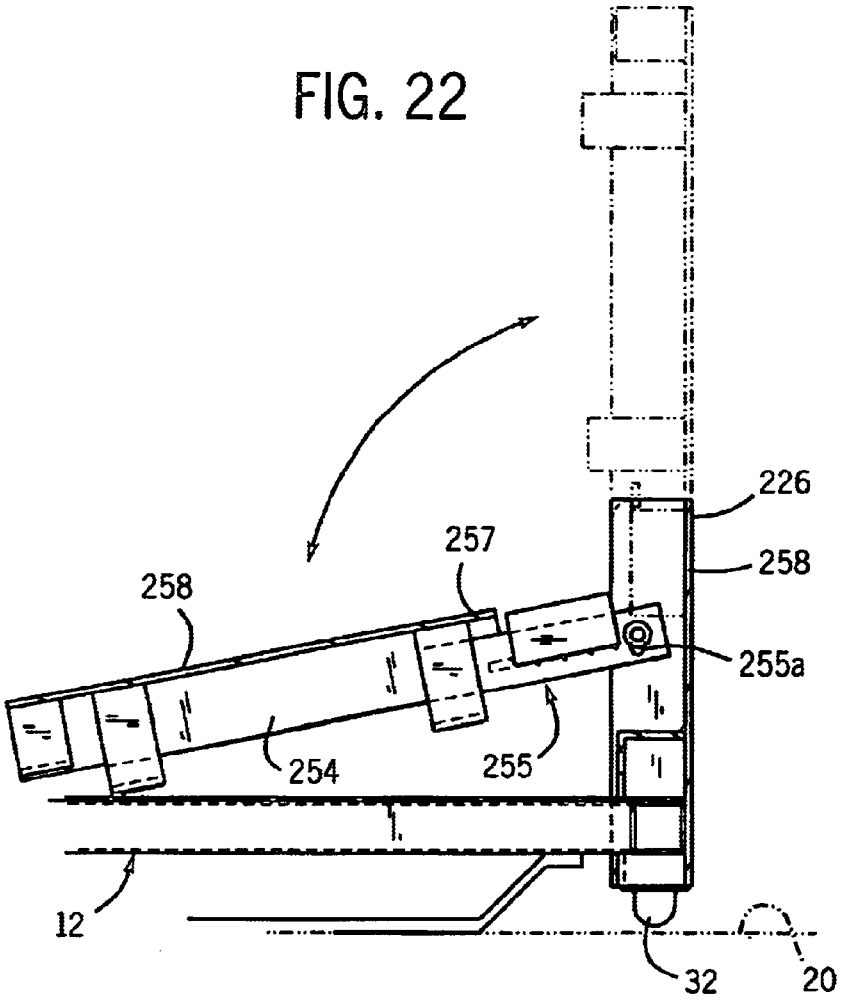
FIG. 22 is a cross-sectional view of the storage container of the present invention taken along line 22—22 of FIG. 20.
Figure 23:
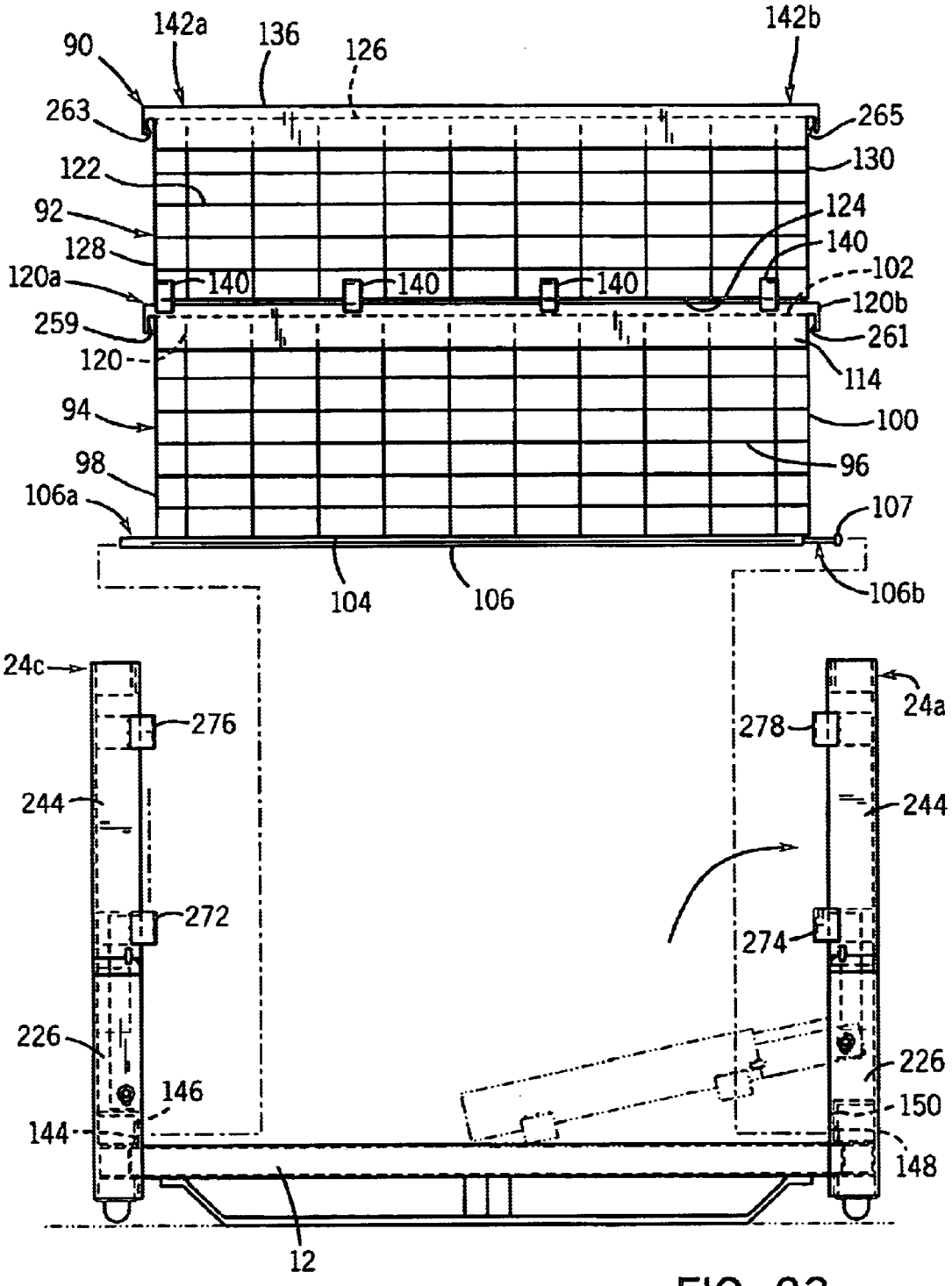
FIG. 23 is an exploded, side elevational view of the storage container of FIG. 21.

Referring to FIG. 18, each upper member 244 of support posts 24*a*–24*d* is generally L-shaped and is defined by sidewall 256 and by rear wall 258. As best seen in FIGS. 22–24, connection elements 255 depend from lower ends 257 of sidewalls 256, respectively, of lower members 244. Connection elements 255 of lower members 244 further include oblong apertures 255*a* therein. It can be appreciated that connection elements 255 of upper members 244 are positionable adjacent corresponding lower members 26 such that oblong apertures 255*a* in connection elements 255 respectively, are aligned with apertures 234*a* in sidewalls 234 of corresponding lower members 226.

Figure 28:
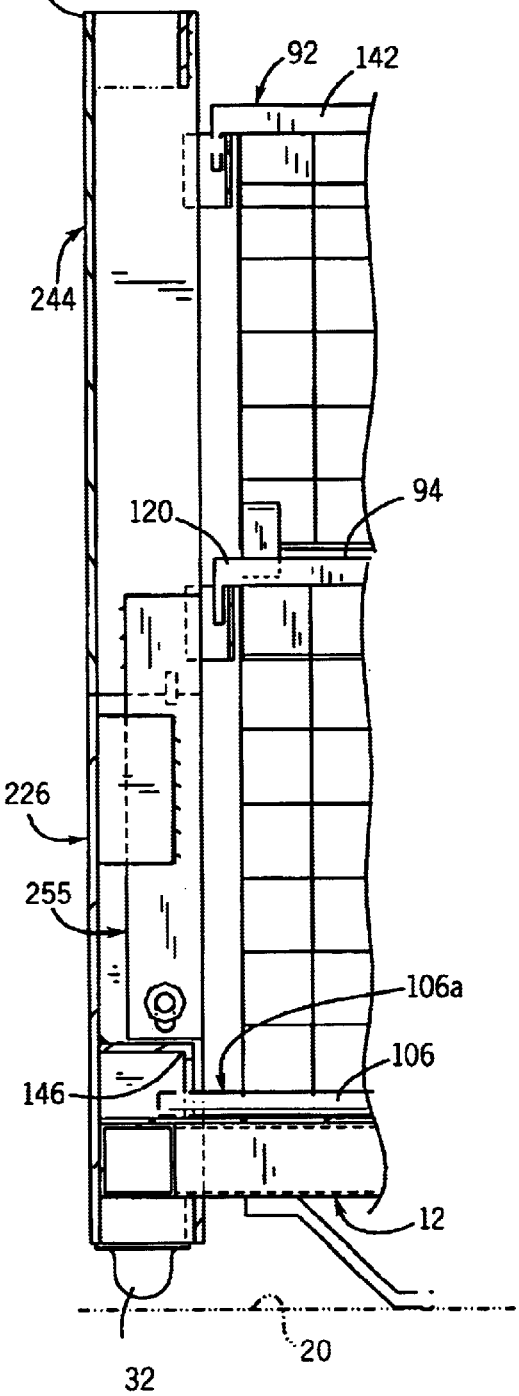
FIG. 28 is a cross-sectional view, similar to FIG. 25, showing a first portion of the storage container of the present invention.

In order to pivotably connect upper members 244 and corresponding lower members 226, shafts 60 of carriage bolts 62 extend through apertures 234*a* in sidewalls 234 of lower members 226 and through corresponding apertures 255*a* in connection elements 255 of corresponding upper members 244. Nuts 66 are threaded onto corresponding shafts 60 of carriage bolts 62 to retain carriage bolts 62 in position. As best seen in FIGS. 22 and 28, the diameter of shafts 60 of carriage bolts 62 are less than the vertical length of oblong apertures 255*a* in connection elements 255 so as to allow limited vertical movement of upper members 244 with respect to corresponding lower members 226 between a vertical pivoting position and a locked position. Locking pins 68 project laterally from sidewalls 256 of upper members 244 and are receivable within corresponding notches 248 and 252*a* when upper members 244 are in the locking position so as to prevent upper members 244 from pivoting with respect to lower members 226.

As heretofore described, support posts 24*a* and 24*b* are interconnected by upper and lower panels 69 and 71, respectively. Lower panel 69 includes upper support bar 70 extending between rear wall 238 of lower members 226 of support posts 24*a* and 24*b*. Wire mesh screen 72 also extends between rear walls 238 of lower members 226 of support posts 24*a* and 24*b*, as well as, between upper support bar 70 and base 12. Upper panel 71 includes upper and lower support bars 74 and 76, respectively, extending between rear walls 258 of upper members 244 of support posts 24*a* and 24*b*. Upper and lower support bars 74 and 76, respectively, of upper panel 71 are spaced from and parallel to each other. Wire mesh screen 78 also extends between rear walls 258 of upper members 244 of support posts 24*a* and 24*b*, as well as, between upper and lower support bars 74 and 76, respectively.

Support posts 24*c* and 24*d* are interconnected by upper and lower panels 79 and 81, respectively. Lower panel 79 includes upper support bar 80 extending between rear walls 238 of lower members 226 of support posts 24*c* and 24*d*. Wire mesh screen 82 also extends between rear walls 238 of lower members 226 of support posts 24*c* and 24*d*, as well as, between upper support bar 80 and base 12. Upper panel 81 includes upper and lower support bars 84 and 86, respectively, extending between rear walls 258 of upper members 244 of support posts 24*c* and 24*d*. Upper and lower support bars 84 and 86, respectively, of upper panel 81 are spaced from and parallel to each other. Wire mesh screen 88 also extends between rear walls 258 of upper members 244 of support posts 24*c* and 24*d*, as well as, between upper and lower support bars 84 and 86, respectively.

Storage container 210 further includes a pair of removable gates 90. As best seen in FIG. 23, each gate 90 includes upper and lower panels 92 and 94, respectively. As heretofore described, each lower panel 94 includes a generally rectangular wire mesh screen 96 having opposite ends 98 and 100, and opposite sides 102 and 104. Lower support rod 106 extends along side 104 of wire mesh screen 96 and has a first end 106*a* extending beyond end 98 thereof and a second end 106*b* extending beyond end 100 thereof. Second end 106*b* of lower support rod 106 includes terminates at an enlarged head 107, for reasons hereinafter described. Similarly, upper support rod 108 extends along side 102 of wire mesh screen 96. A generally J-shaped support bracket 114 is positioned over and is interconnected to upper support rod 108. Support bracket 114 includes a base 116 having support legs 118 and 120 depending therefrom for receiving support rod 108 therebetween. Leg 120 of support bracket 114 has a first end 120*a* that extends beyond end 98 of wire mesh screen 96 and a second end 120*b* that extends beyond end 100 of wire mesh screen 96. Notches 259 and 261 are provided in ends 120*a* and 120*b*, respectively, of support bracket 114, for reasons hereinafter described.

Upper panels 92 of gates 90 include wire mesh screens 122 having opposite sides 124 and 126 and opposite ends 128 and 130. Lower support rods 132 extend along the entire length of sides 124 of wire mesh screens 122. Similarly, upper support rods 134 extend along the entire length of sides 126 of wire mesh screens 122. Generally J-shaped support brackets 136 are positioned over and are interconnected to corresponding upper support rods 134. Support brackets 136 include base 138 having legs 139 and 142 depending therefrom for receiving a corresponding upper support rod 134 therebetween. Leg 142 of each support bracket 136 has a first end 142*a* that extends beyond end 128 of wire mesh screen 122 and a second end 142*b* that extends beyond end 130 of wire mesh screen 122. Notches 263 and 265 are provided in ends 142*a* and 142*b*, respectively, of support bracket 136, for reasons hereinafter described. As heretofore described, upper and lower panels 92 and 94, respectively, of gates 90 are interconnected by a plurality of generally U-shaped connectors 140 spaced along corresponding support brackets 114 of lower panels 94.

In order to assemble storage container 210, upper members 244 are pivoted with respect to corresponding lower members 226 from the collapsed position, FIG. 20, to the vertical pivoting position, FIG. 18. Thereafter, upper panels 94 are released such that upper panels 94 move vertically downward to the locked positions wherein locking pins 68 become seated in corresponding notches 248 and 252*a* in order to lock support posts 24*a*–24*d* in position.

One of the pair of gates 90 is positioned between support posts 24*a* and 24*c*. As best seen in FIG. 23, first end 106*a* of lower support rod 106 is inserted into generally rectangular opening 144 in plate 146 that extends from sidewall 234 of lower member 226 of support post 24*c*. Head 107 at second end 106*b* of lower support rod 106 is inserted through enlarged portion 148*a* of opening 148 in plate 150 that extends from sidewall 234 of lower member 226 of support post 24*a*. Openings 144 and 148 through plates 146 and 150, respectively, are of sufficient vertical length to allow for limited vertical movement of lower support rod 106, and hence, of lower panel 94 of gate 90.

Lower panel 94 of gate 90 between support posts 24*a* and 24*c* is pivoted to a vertical position such that notches 259 and 261 provided in ends 120*a* and 120*b*, respectively, of support bracket 114 overlap corresponding brackets 272 and 274 projecting from sidewalls 254 of upper members 244 of support posts 24*a* and 24*c*, respectively. Lower panel 94 of gate 90 is then released so as to allow lower panel 94 to move vertically downward such that brackets 272 and 274 become seated in corresponding notches 259 and 261, respectively.

Figure 29:
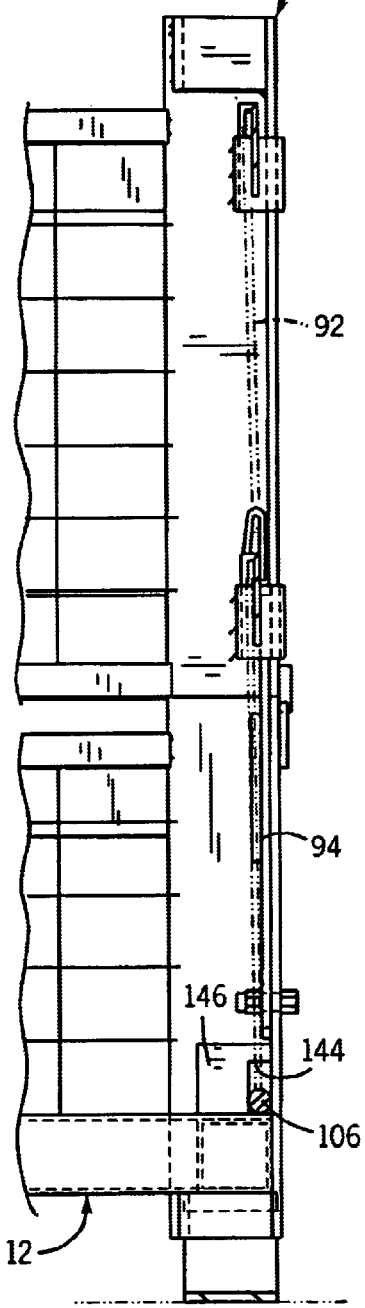
FIG. 29 is a cross-sectional view, similar to FIG. 26, showing a second portion of the storage container of the present invention.

With lower panel 94 of gate 90 fixed between support posts 24*a* and 24*c*, upper panel 92 of gate 90 is pivotable between a folded configuration, wherein upper panel 92 is adjacent lower panel 92 and a vertical configuration, FIG. 29, wherein upper panel 92 and lower panel 94 of gate 90 lie in a common plane. As upper panel 92 is pivoted to the vertical configuration, notches 263 and 265 in ends 142*a* and 142*b*, respectively, of support bracket 136 are aligned with corresponding brackets 276 and 278, respectively, projecting from sidewalls 254 of upper members 244 of support posts 24*a* and 24*c*, respectively. Upper panel 92 of gate 90 is then released so as to allow upper panel 92 to move vertically downward such that brackets 276 and 278 become seated in corresponding notches 263 and 265, respectively, FIGS. 18 and 28.

The other of the pair of gates 90 is positioned between support posts 24*b* and 24*d*. First end 106*a* of lower support rod 106 is inserted into generally rectangular opening 174 in plate 176 that extends from sidewall 234 of lower member 226 of support post 24*d*. Head 107 at second end 106*b* of lower support rod 106 is inserted through enlarged portion 178*a* of opening 178 in plate 180 that extends from sidewall 234 of lower member 226 of support post 24*b*. Openings 174 and 178 through plates 176 and 180, respectively, are of sufficient vertical length to allow for limited vertical movement of lower support rod 106, and hence, of lower panel 94 of gate 90.

Lower panel 94 of gate 90 between support posts 24*b* and 24*d* is pivoted to a vertical position such that notches 259 and 261 provided in ends 120*a* and 120*b*, respectively, of support bracket 114 overlap corresponding brackets 282 and 284 projecting from sidewalls 254 of upper members 244 of support posts 24*b* and 24*d*, respectively. Lower panel 94 of gate 90 is then released so as to allow lower panel 94 to move vertically downward such that brackets 282 and 284 become seated in corresponding notches 259 and 261, respectively.

With lower panel 94 of gate 90 fixed between support posts 24*b* and 24*d*, upper panel 92 of gate 90 is pivotable between a folded configuration, wherein upper panel 92 is adjacent lower panel 92 and a vertical configuration, wherein upper panel 92 and lower panel 94 of gate 90 lie in a common plane. As upper panel 92 is pivoted to the vertical configuration, notches 263 and 265 in ends 142*a* and 142*b*, respectively, of support bracket 136 are aligned with corresponding brackets 286 and 288, respectively, projecting from sidewalls 254 of upper members 244 of support posts 24*b* and 24*d*, respectively. Upper panel 92 of gate 90 is then released so as to allow upper panel 92 to move vertically downward such that brackets 286 and 288 become seated in corresponding notches 263 and 265, respectively, FIG. 18.

In order to collapse storage container 210, the process is reversed. Upper panel 92 of the gate 90 between support posts 24*b* and 24*d* is lifted vertically such that notches 263 and 265 are disengaged from corresponding brackets 286 and 288, respectively, thereby allowing upper panel 92 to pivot. The vertical movement of upper panel 92 is limited by end caps 290 and 292 provided on the upper ends of support posts 24*b* and 24*d*, respectively. Thereafter, upper panel 92 is returned to the folded configuration. Lower panel 94 of the gate 90 between support posts 24*b* and 24*d* is removed by lifting lower panel 94 vertically such that notches 259 and 261 are disengaged from brackets 282 and 284, respectively, and pivoting lower panel 94 from its vertical position. Head 107 at second end 106*b* of lower support rod 106 is removed from opening 178 in plate 180 through enlarged portion 178*a* of opening 178. In addition, first end 106*a* of lower support rod 106 is removed from into generally rectangular opening 174 in plate 176 thereby disengaging gate 90 from storage container 210.

Gate 90 between support posts 24*a* and 24*c* is removed by lifting upper panel 92 vertically such that notches 263 and 265 are disengaged from corresponding brackets 276 and 278, respectively, thereby allowing upper panel 92 to pivot. The vertical movement of upper panel 92 is limited by end caps 294 and 296 provided on the upper ends of support posts 24*a* and 24*c*, respectively. Thereafter, upper panel 92 is returned to the folded configuration. Lower panel 94 of the gate 90 between support posts 24*a* and 24*c* is removed by lifting lower panel 94 vertically such that notches 259 and 261 are disengaged from brackets 272 and 274, respectively, and pivoting lower panel 94 from its vertical position. Head 107 at second end 106*b* of lower support rod 106 is removed from opening in plate 150 through enlarged portion 148*a* of opening 148. In addition, first end 106*a* of lower support rod 106 is removed from into generally rectangular opening 144 in plate 146 thereby disengaging the second of the pair of gates 90 from storage container 210.

In order to fully collapse storage container 210, upper members 244 of support posts 24*a*–24*d* are lifted vertically with respect to corresponding lower members 26 to the vertical pivoting position, wherein pins 68 are disengaged from corresponding notches 248 and 252*a*. Thereafter, upper members 244 are pivoted on corresponding shafts 60 of carriage bolts 62 towards base 12 to the collapsed position, FIG. 20.

Various modes of carrying out the invention are contemplated as being within the scope of the following claims particularly pointing out and distinctly claiming the subject matter which is regarded as the invention.

I claim:

1. A collapsible storage container, comprising:

a generally flat base having an upper surface;

a first pair of support posts extending from the base, each support post of the first pair of support posts including:

a lower member having a first end interconnected to the base and a second, opposite end;

an upper member having a first end pivotably connected to the second end of the lower member, the upper member pivotable between a first supporting position and a second collapsed position; and a locking structure for selectively retaining the upper member in the supporting position;

a lower sidewall extending between the lower members of the support posts of the first pair of support posts;

an upper sidewall extending between the upper members of the support posts of the first pair of support posts;

a second pair of support posts extending from the base, each support post of the second pair of support posts including:

a lower member having a first end interconnected to the base and an opposite second end;

an upper member having a first end pivotably connected to the second end of the lower member of a corresponding support post of the second pair of support posts, the upper member of each support post of the second pair of support posts pivotable between a first supporting position and a second collapsed position; and a locking structure for selectively retaining the upper member of a corresponding support post of the second pair of support posts in the supporting position;

a second lower sidewall extending between the lower members of the support posts of the second pair of support posts;

a second upper sidewall extending between the upper members of the support posts of the second pair of support posts;

a first removable wall having first and second sides;

a lower panel having first and second sides and upper and lower edges;

an upper panel having first and second sides and upper and lower edges; and a connection element for pivotably connecting the upper edge of the lower panel and the lower edge of the upper panel such that the first removable wall is movable between a first vertical configuration wherein the lower and upper panels lie in a common plane and a folded configuration wherein the lower and upper panels are positioned adjacent each other, a first wall connection pin projecting laterally from the first side of the lower panel of the first removable wall, the first wall connection pin terminating at an enlarged head;

a second wall connection pin projecting laterally from the second side of the first removable wall;

a first pin support element projecting from the upper member of one of the support posts of the first pair of support posts and being directed toward a corresponding upper member of one of the support posts of the second pair of support posts, the first pin support element including a pin receipt recess therein;

a second pin support element projecting from the upper member of one of the support posts of the second pair of support posts and being directed toward a corresponding upper member of one of the support posts of the first pair of support posts, the second pin support element including a pin receipt recess therein;

a first mounting pin projecting laterally from the first side of the upper panel of the first removable wall, the first mounting pin receivable in the pin receipt recess of the first pin support element;

second mounting pin projecting laterally from the second side of the upper panel of the first removable wall, the second mounting pin receivable in the pin receipt recess of the second pin support element, wherein:

the lower members of the support posts of the first pair of support posts include openings directed toward corresponding lower members of the support posts of the second pair of support posts, one of the openings having wide diameter portion for allowing the enlarged head of the first wall connection pin to pass therethrough and a reduced diameter portion for capturing the enlarged head of the first wall connection pin;

the lower members of the support posts of the second pair of support posts include openings directed toward corresponding lower member of the support posts of the first pair of support posts;

the openings in the lower members of the suppot posts of the first pair of support posts are axially aligned with corresponding openings in the lower members of the support posts of the second pair of support posts;

the first wall connection pin being insertable through the wide diameter portion of the one of the openings in one of the lower members of the support posts of the first pair of support posts; and the second wall connection pin is receivable in an opening in one of the lower members of the support posts of the second pair of support posts.

2. The container of clam 1 wherein the second end of each lower member includes a notch and wherein the locking structure of each of the support posts of the first pair of support posts includes a pin projecting laterally from a corresponding upper member of each of the support posts of the first pair of support posts, the pin seated in the notch in the second end of a corresponding lower member with the upper member in the supporting position.

3. The container of claim 1 wherein the upper panel is vertically movable with respect to the lower panel between a first seated position wherein the first mounting pin is received in the pin receipt recess of the first pin support element and the second mounting pin is received in the pin receipt recess of the second pin support element and a second removable position wherein the first mounting pin is vertically spaced from the pin receipt recess of the first pin support element and the second mounting pin is vertically spaced from the pin receipt recess of the second pin support element.

4. The container of claim 3 wherein the upper member of one of the support posts of the first pair of support posts terminates at a stop, the stop limiting vertical movement of upper panel with respect to the lower panel.

5. The container of claim 1 further comprising:

a second removable wall having first and second sides;

a first connection pin projecting laterally from the first side of the second removable wall, the first connection pin receivable in an opening in one of the lower members of the support posts of the first pair of support posts; and a second connection pin projecting laterally from the second side of the second removable wall, the second connection pin receivable in an opening in one of the lower members of the support posts of the second pair of support posts.

* * * * *